United States Patent [19]

Harper

[11] Patent Number: 4,924,607

[45] Date of Patent: May 15, 1990

[54] THREADED WEDGE RETAINER FOR TOP LIFT

[75] Inventor: Paul W. Harper, Rochester, N.Y.

[73] Assignee: Heelox Corporation, Rochester, N.Y.

[21] Appl. No.: 332,164

[22] Filed: Apr. 3, 1989

[51] Int. Cl.[5] ..... A43B 21/36; A43B 21/42

[52] U.S. Cl. ..... 36/42; 36/36 R

[58] Field of Search ..... 36/34 R, 36 R, 36 A, 36/36 C, 35 A, 41, 42

[56] References Cited

U.S. PATENT DOCUMENTS

| | | | |
|---|---|---|---|
| 97,681 | 12/1869 | Norburn | 36/42 |
| 1,286,054 | 11/1918 | Mizsak | 36/42 |
| 1,477,045 | 12/1923 | Ellensohn | 36/42 |
| 1,762,170 | 6/1930 | Gentile et al. | 36/34 R |
| 1,949,346 | 2/1934 | Bain | 36/36 R |
| 2,137,816 | 11/1938 | Sullivan | 12/147 |
| 2,825,154 | 3/1958 | Windle | 36/38 |
| 3,041,747 | 7/1962 | Pfeil | 36/42 |
| 3,133,362 | 5/1964 | Faccin | 36/42 |
| 3,822,709 | 7/1974 | Griner | 36/34 R |
| 4,403,426 | 9/1983 | Kaplan | 36/36 R |
| 4,443,956 | 4/1984 | Caccavale | 36/42 |
| 4,819,344 | 4/1989 | Schuller | 36/35 A |

FOREIGN PATENT DOCUMENTS

| | | | |
|---|---|---|---|
| 595937 | 4/1934 | Fed. Rep. of Germany | 36/42 |
| 597247 | 8/1959 | Italy | 36/34 R |
| 650122 | 12/1962 | Italy | 36/42 |
| 668317 | 9/1964 | Italy | 36/42 |

*Primary Examiner*—Steven N. Meyers

*Attorney, Agent, or Firm*—Stonebraker, Shepard & Stephens

[57] ABSTRACT

A releasable retainer for a replaceable top lift (30) of a shoe heel (10) includes a threaded wedge (25) threaded into a retainer hole (18) that intersects a mounting hole (15) for the top lift. There, a dowel rod or tube (20) holding the top lift at its bottom end (23) has a slot (21) at its upper end (22) engaged by a conical wedge tip (26) of threaded wedge (25) threaded into retainer hole (18). The wedging action of conical tip (26) in slot (21) of tube (20) or rod (50) spreads the tube and holds it firmly in mounting hole (15), against both rotary and axial movement.

20 Claims, 5 Drawing Sheets

THREADED WEDGE RETAINER FOR TOP LIFT

BACKGROUND

Replacement of worn top lifts for high heels shoes has long been recognized as a problem. The top lifts wear out fast and then the shoes are either thrown away or taken to the shoe repair shop for the top lift replacement. Although there have been many suggestions for a top lift replacement simple enough to be done at home, all of these have involved some shortcoming. Many of them hold the top lift dowel so firmly in place in the heel that it cannot be removed and replaced with household tools; and others, that allow the top lift to be replaced with simple tools, hold it so loosely in the heel that it can turn or come loose and fall out. All of these consequences are unacceptable, and having the top lift dowel fall out of the shoe heel is even dangerous, since it weakens the heel and may allow it to break. Such shortcomings probably explain why none of the suggestions for home replacement of top lifts are presently available in the marketplace.

My invention aims at a top lift that is both firmly and reliably retained in a shoe heel and also easily removed and replaced by using a simple tool. Existing shoes can be converted to my new top lift retainer system, which allows the wearer to replace worn top lifts easily and conveniently. Once a shoe repairman has installed my threaded wedge retainer system into existing shoe heels, he can then provide the customer with easily replaceable doweled top lift elements and a simple tool allowing do-it-yourself top lift renewal. My system can also provide the shoe repairman with the tools and fixtures necessary for modifying existing shoes to receive a highly reliable and easily operated retainer that allows the woman who wears the shoes to change the top lifts herself.

SUMMARY OF THE INVENTION

My system of retaining and replacing a top lift applies to a shoe heel having a top lift mounting hole. The top lift itself is mounted on the lower end of a dowel having a slip fit in the mounting hole, and the dowel has a slot extending axially downward from an upper end, opposite the top lift. A retainer hole, bored in the heel to intersect the mounting hole, is threaded to receive a retainer element having a conical wedge tip that extends into the mounting hole in the region of the slot in the dowel. The retainer element is arranged so that when advanced by its threads into the retainer hole, the conical wedge tip rotatably wedges into the dowel to enlarge an upper region of the dowel, for retaining the dowel in place. When retracted by its threads from the retainer hole, the conical wedge tip rotatably withdraws from the dowel, allowing the dowel to contract so that the dowel and top lift can be removed from the mounting hole and replaced by a new doweled top lift element. The conical tip of the threaded wedge preferably enters the slot in the dowel so that the wedge not only expands the dowel in the mounting hole, but holds the dowel against rotation in the mounting hole. The dowel can be either a rod or tube, and the top lift can be mounted on a lower end of the dowel in various ways that include molded attachment to the dowel or attachment to a pin pressed into a tubular dowel. The threaded wedge can be retained and concealed within the retainer hole by a washer adhered in a counterbore; and a simple tool, such as an Allen wrench, can reach through the washer to operate the wedge. One revolution of the wedge is enough to move it between locked and unlocked positions.

DRAWINGS

DETAILED DESCRIPTION

Top lifts are presently retained in high heel shoes in two basic ways. One way, favored by U.S. manufacturers, is to mold the top lift onto a knurled steel pin called a "dowel nail". This is press fit into a bored mounting hole in a resinous heel so that the dowel strengthens the heel, while holding the top lift in place. When the top lift becomes worn, the steel of the dowel pin can click on the floor, causing a harsh sound. Walking on the pin is also hazardous. The harsh impact of each step on the dowel pin can injure the legs and spinal column. Also, the pin does not provide sufficient friction with floors and pavements, and it can easily slip and cause the wearer to fall. Replacing a worn top lift requires removing the dowel from the mounting hole, but this cannot be done with ordinary household tools. So if the top lifts have to be replaced, the shoes must be taken to a repair shop. This is burdensome enough so that many women discard their shoes, rather than bother with the repair process.

Another top lift retainer, favored by foreign manufacturers, is to press a steel dowel tube into a mounting hole in a heel so that the dowel tube strengthens the heel and holds the top lift in the bottom of the tube. This is done by a short knurled stud that extends upward from the top lift into the bottom of the tube. When the top lift wears out, the wearer walks on the metal stud and the tube tip, causing similar problems. Here again, a worn top lift cannot be replaced by using household tools.

Figure 2:
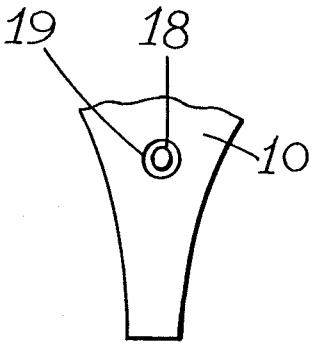
FIG. 2 is a fragmentary cross-sectional view of the shoe of FIG. 1, taken along the line 2—2 thereof.
Figure 1:
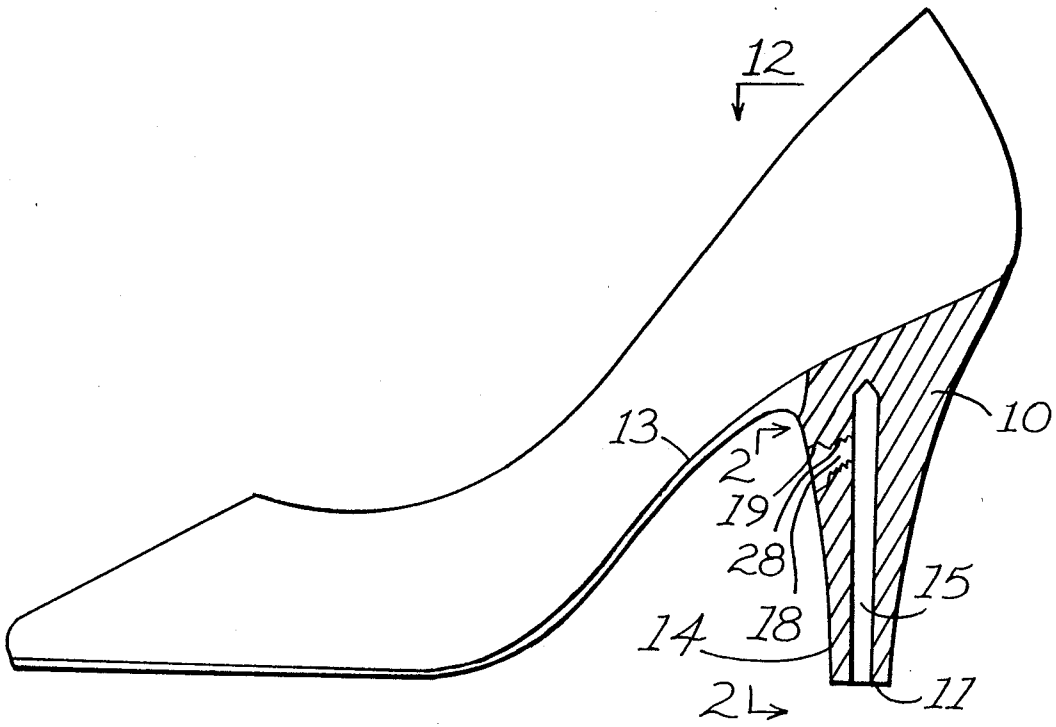
FIG. 1 is a partially cutaway view of a high heel shoe modified to receive my threaded wedge retainer for a top lift.
Figure 5:
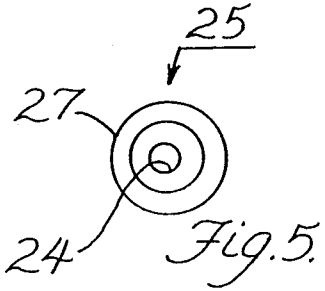
FIG. 5 is an elevational view of the tool-engaging end of the threaded wedge of FIG. 4.
Figure 6:
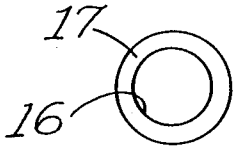
FIG. 6 is an elevational view of a washer that is preferably mounted in a counterbore of a retainer hole, as shown in FIG. 4.

My threaded wedge retainer for a doweled top lift element uses the existing mounting hole 15 in a heel 10 of a shoe 12, as shown in FIG. 1. Mounting hole 15 extends vertically from the bottom 11 of heel 10 upward to the vicinity of a shank 13 that overlies the top of heel 10.

Instead of a press fit of a dowel nail or tube in mounting hole 15, I use a slip fit of a dowel 20, which can be either a tube or rod, similar to the tubes and rods already in use for mounting top lifts 30. With a drill or reamer, I slightly enlarge mounting hole 15 so that a dowel rod or tube 20 has a slip fit, allowing dowel 20 to be slid easily in and out of heel 10. Since I prefer a dowel tube to a dowel nail, for practicing my invention, the preferred dowel tube 20 is shown in the embodiments of FIGS. 1–9.

To retain tube 20 firmly in place within mounting hole 15 in heel 10, so that tube 20 does not rotate or move axially while supporting top lift 30 on bottom 11 of heel 10, I use a threaded wedge retainer that includes a threaded wedge 25 interacting with a slot 21 formed in tube 20. Slot 21 extends downward from an open top 22 of tube 20, and threaded wedge 25 has a conical wedge tip 26 that can enter slot 21 in tube 20. Moving the wedge tip 26 is done by means of external threads 27 on threaded wedge 25, mating with internal threads 28 of a retainer hole 18 formed in heel 10, so that threaded wedge 25 can be screwed into retainer hole 18 to advance conical tip 26 into slot 21 of tube 20. This tends to spread slot 21 open, to enlarge the upper region of tube 20; and it also presses tube 20 firmly against the rear side of mounting hole 15. The mechanical advantage provided by threads 27 and 28 adds to the mechanical advantage of conical tip 26 in applying considerable holding force to tube 20, with very little actuation pressure being applied. At the same time, the conical tip 26 of threaded wedge 25 holds tube 20 against rotating within heel 10 so that top lift 30 is locked firmly against the bottom 11 of heel 10, where it can neither rotate nor come loose.

I have found that a single 360° revolution of threaded wedge 25 is enough to move it between fully locked and fully unlocked positions. Light turning of a tool driving threaded wedge 25 into retainer hole 18 creates a very forceful wedging action of conical tip 26 into slot 21 and is quite reliable in holding tube 20 firmly in place. Since relatively light torque is needed in driving threaded wedge 25 into locking engagement with tube 20, a driver having a torque-limiting clutch can ensure that threads 28 are not stripped out of heel 10.

I prefer that retainer hole 18 have a counterbore 19 in which a washer 17 can be adhered to conceal threaded wedge 25 and prevent it from being backed out of retainer hole 18. A hole 16 in washer 17 allows passage of a tool that can engage and operate threaded wedge 25. For this, I prefer an Allen wrench engaging a hexagonal socket 24, but threaded wedge 25 can also be turned by various screwdriver bits or wrenches.

Figure 4:
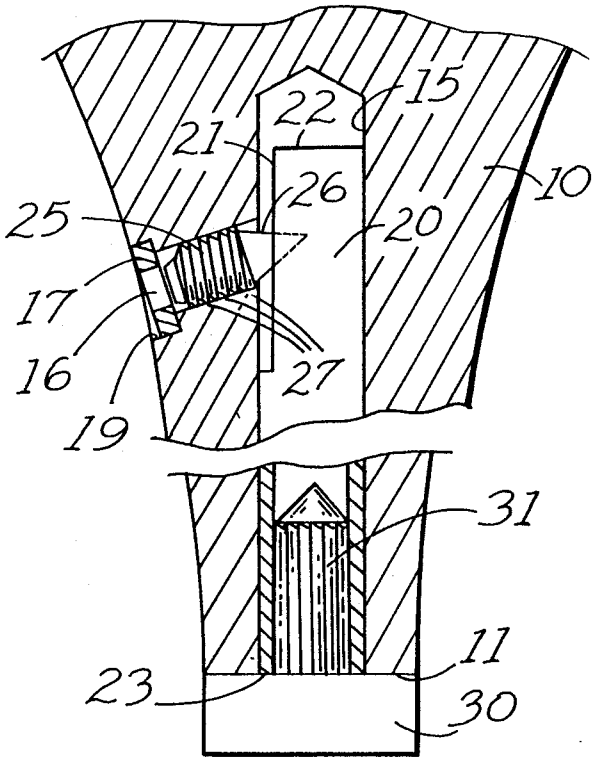
FIG. 4 is an enlarged, fragmentary cross-sectional view of the heel of the shoe of FIG. 1, showing my threaded wedge retainer holding a top lift assembly in place.

Tubes 20 can be preformed with slots 21 and sold to shoe repairmen for use in my threaded wedge retainer system. A preferred way of making tube 20 is by rolling it from flat stock, using a progressive die that leaves a seam 29 in tube 20. Slot 21 can be formed by cutting away material, before tube 20 is rolled; and a top lift 30 can be permanently mounted on the bottom of a dowel tube 20. Alternatively, existing top lift support tubes can be purchased by the shoe repairman, who can grind slots 21 with an abrasive disk. Each slot 21 extends downward far enough from open top 22 of tube 20 to ensure that conical tip 26 of threaded wedge 25 engages slot 21. Top lift 30 has a multi-splined stud 31 pressed into the bottom 23 of tube 20, as shown in FIG. 4, to prevent both rotational and axial movement. When top lift 30 is worn out, threaded wedge 25 is loosened, to free conical tip 26 from slot 21, so that tube 20, with its worn top lift 30, can be removed from heel 10 and discarded. A new tube 20, permanently mounting a new top lift 30, is then inserted into mounting hole 15 in heel 10, where it is retained by threaded wedge 25, to hold top lift 30 in place at the bottom 11 of heel 10.

A shoe repairman, interested in using my threaded wedge retainer system, would be provided with a reamer, drill jig, step drill, and tap. With these tools, the repairman can ream out the top lift mounting hole so that the top lift dowel has a slip fit in the mounting hole and can drill and tap retainer hole 18 accurately into the heel 10 of an existing high heel shoe so that retainer hole 18 intersects mounting hole 15. I prefer that this intersection occur well up into heel 10, as illustrated in FIG. 1, and that retainer hole 18 be located on a forward facing side 14 of heel 10, facing toward shank 13, as shown in FIG. 1. This requires that retainer hole 18 slope downward and forward from the region of its intersection with mounting hole 15. By using an extension step drill and a drill jig, it is possible for a hand-held electric drill to be operated below the arch and beyond the sole of shoe 12, while boring retainer hole 18. The preferred location of this hole places it in an inconspicuous location on heel 10, where it does not disfigure the appearance of shoe 12.

After drilling, hole 18 is tapped to provide threads 28 to receive threaded wedge 25. By using a drill or reamer, mounting hole 15 is enlarged just enough to provide a slip fit for tube 20. Threaded wedges 25, washers 17, and the necessary Allen wrenches or other rotating tools are also supplied to the shoe repairman. One of the threaded wedges 25 is threaded into each retainer hole 18, and a washer 17 is preferably glued into counterbore 19 behind threaded wedge 25.

Then the woman who owns the shoe can be provided with replaceable top lifts, permanently mounted in tubes 20, and an Allen wrench or other tool for rotating wedge 25. When a top lift 30 becomes worn, she can reach through the hole 16 in washer 17 with a tool to engage threaded wedge 25 and turn it counterclockwise one revolution. This releases tube 20 so that it can be slid out of mounting hole 15 to remove worn top lift 30, which is discarded, along with tube 20. She then inserts a new dowel tube 20 into mounting hole 15 so that slot 21 faces forward and slides past the tip 26 of wedge 25, and so that a fresh top lift 30, mounted on the lower end of tube 20, is positioned against the bottom 11 of heel 10. Then by turning wedge 25 one clockwise revolution to advance conical wedge tip 26 into the slot 21 of the replacement tube 20, she holds the new tube and the new top lift firmly in place.

Unlike set screws, which tend to come loose, conical wedging tip 26 has a high frictional engagement with the sides of slot 21 in tube 20. It is wedged into slot 21 with considerable force, attributable both to the wedge surface of tip 26 and the mechanical advantage of threads 27 and 28, so that threaded wedge 25 does not work loose. It holds tube 20 against rotation so that top lift 30 is always properly oriented on bottom 11 of heel 10; and it reliably holds tube 20 against axial movement until deliberately loosened, for the next replacement of a worn top lift 30.

Several alternative for my threaded wedge retainer system are shown in FIGS. 7–13. For example, in the embodiment of FIG. 7, retainer hole 32 intersects mounting hole 15 coaxially, rather than transversely; and threaded wedge 35 is driven up and down in threaded retainer hole 32, from the top of heel 10. A conical wedge tip 36 of threaded wedge 35 enters top 22 of slotted tube 20 and, for this purpose, has a small taper angle of preferably 5°. This ensures that conical wedge tip 36 enters and spreads the top region of tube 20, rather than driving tube 20 downward in mounting hole 15.

Figure 7:
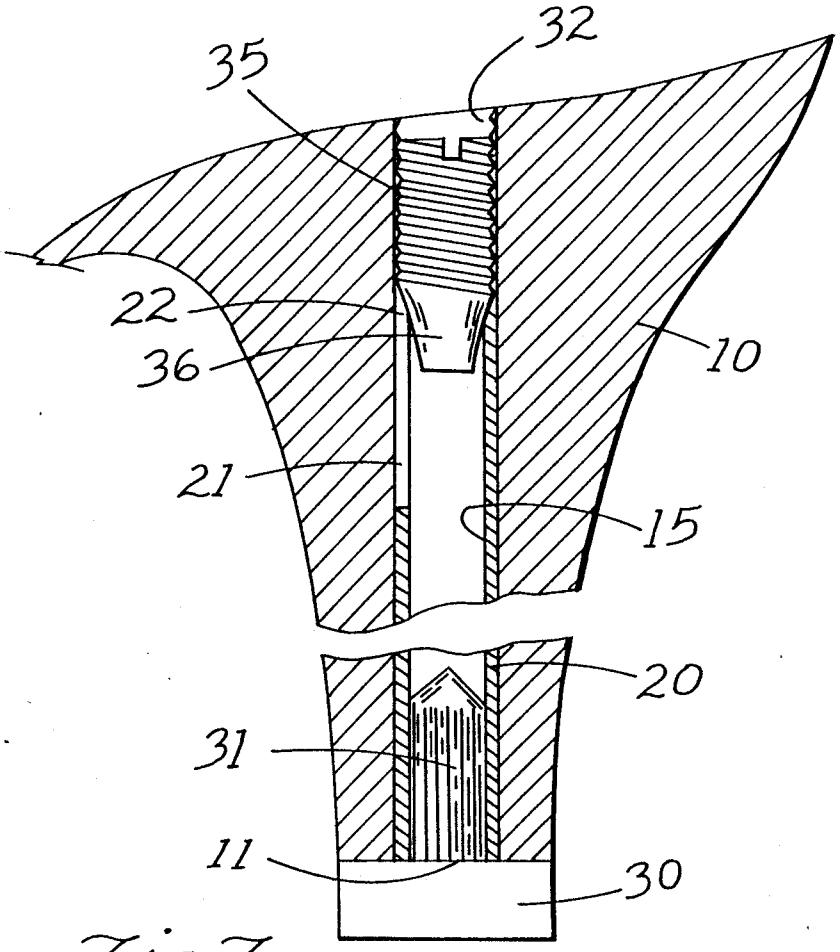
FIG. 7 is an enlarged, fragmentary cross-sectional view of an alternative shoe heel showing an alternative form of my threaded wedge retainer.
Figure 10:
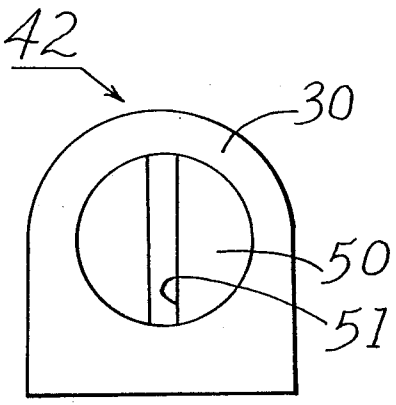
FIGS. 8–11 are top views of alternative embodiments of doweled top lift elements usable in my retainer system.
Figure 9:
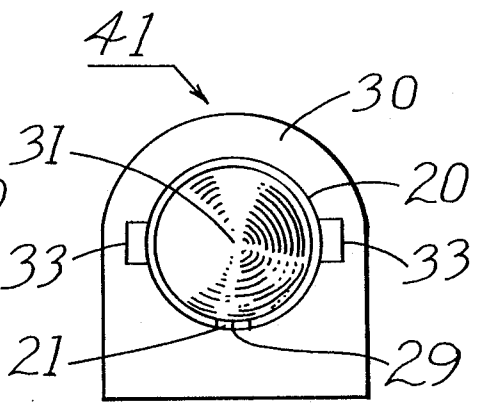

The arrangement of FIG. 7, with threaded wedge 35 entering the top 22 of tube 20, relies on the wedged expansion of tube 20 for holding against both rotational and axial movement. For extra security against rotation of tube 20 and top lift 30 mounted on tube 20, a pair of fins 33 can extend radially outward from tube 20 into heel 10, as shown in FIG. 9. Other alternatives are also possible.

Figure 3:
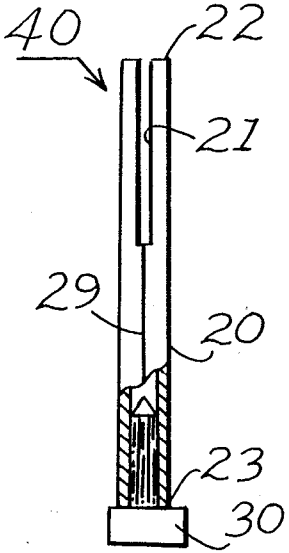
FIG. 3 is a partially cut-away, front elevational view of a tube mounting a top lift for cooperation with my threaded wedge retainer.
Figure 8:
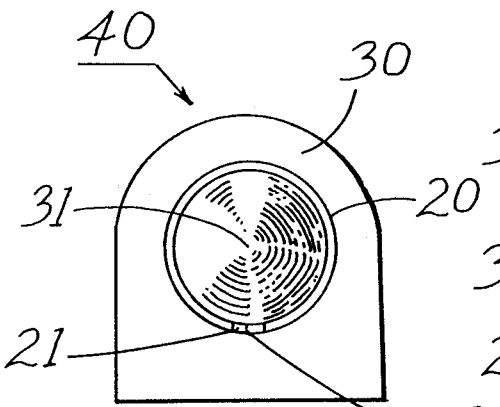

The doweled top lift element 40, as shown in FIG. 8, is the same as the one shown in FIGS. 3 and 4. The doweled top lift element 41, of FIG. 9, is the one shown in FIG. 7 and differs from element 40 in having radial fins 33. The doweled top lift elements 42 and 43, of FIGS. 10 and 11, use dowel rods 50, instead of tubes 20. A parallel sided slot 51 extends down from the top of dowel 50 in the embodiment of FIG. 10; and slot 52 of the doweled top lift element 43 of FIG. 11, which also extends downward from the top of dowel 50, has angled sides, as illustrated, to better accommodate the conical tip 26 of threaded wedge 25.

Figure 13:
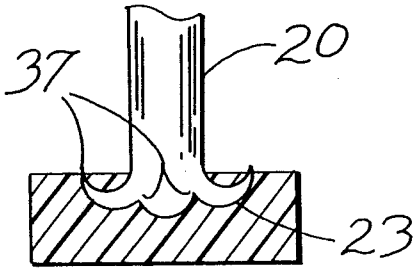
FIGS. 12 and 13 are fragmentary cut-away views of alternative attachments of top lifts to dowel tubes.
Figure 12:
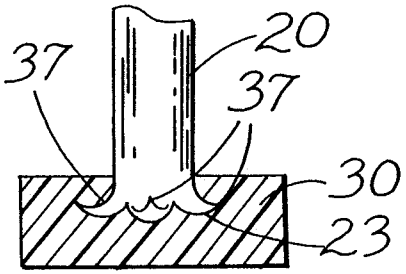
Figure 11:
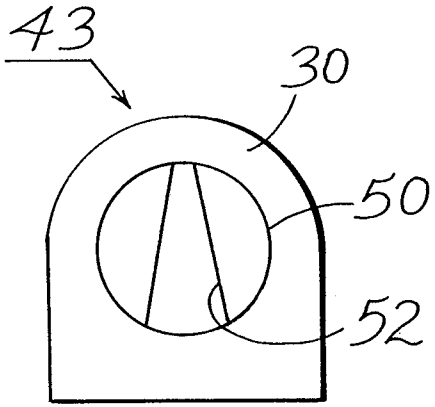

There are several ways that top lifts 30 can be molded directly onto the bottoms of dowel tubes 20, as suggested in FIGS. 12 and 13. Cut and flared barbs 37 at the bottom 23 of dowel tube 20 provide an interlocking anchorage with a top lift 30 molded onto dowel tube 20, as shown in FIG. 12. By exaggerating the upturn of flared barbs 37, as shown in FIG. 13, barbs 37 can not only provide an anchorage with molded top lift 30, but can extend up into the bottom 11 of heel 10 to prevent rotation of top lift 30. This can be used in the embodiment of FIG. 7, to provide extra security against rotation of top lift 30.

I claim:

1. A releasable retainer system for holding a doweled top lift element on a heel of a shoe, said retainer system comprising:

a. said doweled top lift element including a dowel having a slip fit in a mounting hole in said heel and a top lift mounted on a lower end of said dowel;

b. said dowel having a slot open at a periphery of said dowel and extending axially down said open periphery of said dowel from an upper end of said dowel;

c. a threaded retainer receiver located in said heel for transversely intersecting said mounting hole;

d. a retainer element having external threads and a conical wedge tip, said retainer element being threaded into said retainer receiver so that said conical wedge tip extends transversely into said mounting hole in the region of said slot in said dowel; and e. said conical wedge tip being advanceable into said dowel by turning of said threads, so that said wedge tip enters between and engages edges of said open slot at said periphery of said dowel and spreads said slot open to enlarge said dowel and retain said dowel against movement in said mounting hole, and said conical wedge tip being retractable from said slot edges by turning of said threads, so that said wedge tip stops spreading said slot and allows said dowel to contract and be removed axially from said mounting hole for replacing said top lift.

2. The retainer of claim 1 wherein said retainer element has a wrench socket on an end opposite said conical tip.

3. The retainer of claim 1 wherein said retainer receiver has a counterbore, and a washer is secured in said counterbore so that a tool can be inserted through said washer to engage and rotate said retainer element.

4. The retainer of claim 1 wherein said retainer receiver is located forward of said mounting hole on a side of said heel facing a shank of said shoe.

5. The retainer of claim 4 wherein said retainer receive slopes downward and forward from a region of intersection with said mounting hole.

6. The retainer of claim 1 wherein said dowel is a tube.

7. The retainer of claim 1 wherein said dowel is a rod.

8. A system of retaining and replacing a top lift for a heel of a shoe having a top lift mounting hole bored upward into said heel, said system comprising:

a. said top lift being mounted on a lower end of a dowel having a slip fit in said mounting hole;

b. said dowel having a slot extending axially downward from an upper end opposite said top lift;

c. said slot having spaced-apart and confronting edges extending axially of said dowel at a periphery of said dowel;

d. a retainer hole bored in said heel for transversely intersecting said mounting hole;

e. internal threads being disposed within said retainer hole;

f. a retainer element threaded into said internal threads so that a conical wedge tip of said retainer element extends transversely into said mounting hole in the region of said slot in said dowel; and g. said retainer element being arranged so that when advanced by said threads into said retainer hole, said conical wedge tip rotatably wedges between said slot edges in said dowel to expand said slot and enlarge an upper region of said dowel, for retaining said dowel in place, and when retracted by said threads from said retainer hole, said conical wedge tip rotatably withdraws from said slot edges, allowing said dowel to contract so that said dowel and said top lift mounted on said dowel can be removed from said mounting hole and replaced by a new top lift and dowel.

9. The system of claim 8 wherein said retainer element has a tool-receiving recess on an end opposite said conical tip.

10. The system of claim 8 wherein said retainer hole has a counterbore, and a washer is secured in said counterbore so that a tool can be inserted through said washer to engage and operate said retainer element.

11. The system of claim 8 wherein said retainer hole is located on a forward side of said heel facing toward a shank of said shoe.

12. The system of claim 11 wherein said retainer hole slopes downward and forward from a region of intersection with said mounting hole.

13. The system of claim 8 wherein said dowel is a tube.

14. The system of claim 8 wherein said dowel is a rod.

15. A method of retaining and replacing a top lift of a shoe heel having a top lift mounting hole, said method comprising:

a. boring a retainer hole in said heel to transversely intersect said mounting hole;

b. providing internal threads within said retainer hole;

c. mounting a replaceable top lift on a lower end of a dowel having a slot with confronting open edges that extend axially downward from an upper end of said dowel;

d. forming said dowel and said mounting hole so that said dowel has a slip fit in said mounting hole, and slipping said dowel into said mounting hole to position said top lift at a bottom of said heel;

e. screwing a threaded retainer element into said internal threads in said retainer hole so that a conical wedge tip of said retainer element wedges between said edges of said slot in said dowel to expand said dowel and hold said dowel against movement within said mounting hole, to retain said top lift in place on said bottom of said heel; and f. unscrewing said retainer element to withdraw said conical tip from wedged engagement with said slot edges of said dowel to loosen said dowel for removing said dowel from said mounting hole to substitute a new top lift and dowel in said mounting hole for retention by said retainer element.

16. The method of claim 15, including location said retainer hole on a forward side of said heel facing a shank of said shoe.

17. The method of claim 16 including sloping said retainer hole to extend downward and forward from a region of intersection with said mounting hole.

18. The method of claim 15 including counterboring said retainer hole and mounting a washer in the counterbore, to hold said retainer element from backing out of said retainer hole and to permit a tool to pass through said washer to engage and operate said retainer element.

19. The method of claim 15 including using a tube for said dowel.

20. The method of claim 15 including using a rod for said dowel.

* * * * *